US009715977B1

(12) United States Patent
Liu

(10) Patent No.: US 9,715,977 B1
(45) Date of Patent: Jul. 25, 2017

(54) KEYBOARD WITH HEIGHT-ADJUSTABLE KEYS

(71) Applicant: PRIMAX ELECTRONICS LTD., Taipei (TW)

(72) Inventor: Chien-Hung Liu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/201,977

(22) Filed: Jul. 5, 2016

(30) Foreign Application Priority Data

Apr. 29, 2016 (TW) ..... 105113489 A

(51) Int. Cl.
*H01H 13/7065* (2006.01)

(52) U.S. Cl.
CPC ... *H01H 13/7065* (2013.01); *H01H 2203/058* (2013.01); *H01H 2233/03* (2013.01)

(58) Field of Classification Search
CPC ..... H01H 13/705; H01H 13/10; H01H 13/85; H01H 2221/026; H01H 3/125; G06F 1/1662
USPC ..... 200/5 A, 341, 344, 310–314, 512, 516
See application file for complete search history.

(56) References Cited

U.S. PATENT DOCUMENTS 5,735,390 A * 4/1998 Takagi ..... H01H 3/125 200/341
6,068,416 A * 5/2000 Kumamoto ..... H01H 3/125 200/344
7,022,927 B2 * 4/2006 Hsu ..... G06F 1/1615 200/344

* cited by examiner

*Primary Examiner* — Edwin A. Leon
(74) *Attorney, Agent, or Firm* — Kirton McConkie; Evan R. Witt

(57) ABSTRACT

A keyboard with height-adjustable keys is provided. The keyboard includes a key supporting plate, the keys and a movable plate. Each key includes a supporting element. Moreover, plural bulges are disposed on the supporting element. The movable plate is disposed under the key supporting plate. The key is fixed on the key supporting plate. The key is connected with the key supporting plate through the supporting element. Moreover, the plural bulges are penetrated downwardly through the key supporting plate and inserted in the movable plate. While the movable plate is moved, the bulges are pushed and the key is moved toward the key supporting plate with the supporting element. Consequently, the height of the key is lowered.

18 Claims, 7 Drawing Sheets

KEYBOARD WITH HEIGHT-ADJUSTABLE KEYS

FIELD OF THE INVENTION

The present invention relates to a keyboard, and more particularly to a keyboard with height-adjustable keys.

BACKGROUND OF THE INVENTION

Conventionally, a key of a keyboard comprises a keycap, a supporting element, an elastic element, a fixing hook and a key supporting plate. FIG. 1 is a schematic side view illustrating the structure of a key of a conventional keyboard. As shown in FIG. 1, the key comprises a keycap 91, a supporting element 92, an elastic element 93, a fixing hook 94 and a key supporting plate 95. The keycap 91 is disposed over the key supporting plate 95. The elastic element 93 and the supporting element 92 are disposed under the keycap 91. The fixing hook 94 is disposed on the key supporting plate 95. The supporting element 92 is connected with the keycap 91 and the key supporting plate 95. An end of the supporting element 92 is coupled with the fixing hook 94. Consequently, the keycap 91 is supported by the supporting element 92, and the keycap 91 is fixed on the key supporting plate 95 through the supporting element 92. The keycap 91 is pushed upwardly by the elastic element 93. Consequently, a specified height between the keycap 91 and the key supporting plate 95 is maintained.

As mentioned above, the supporting element and the elastic element of the conventional key are fixed on the key supporting plate. In case that the keycap is not depressed, the keycap is continuously supported by the supporting element and the elastic element. Consequently, the height between the keycap and the key supporting plate is fixed. Since the height cannot be changed according to the practical requirements, the thickness of the keyboard is larger. Under this circumstance, it is difficult to store the keyboard and it is not easy to apply the keyboard to the slim-type electronic device. In other words, the conventional keyboard needs to be further improved.

SUMMARY OF THE INVENTION

For overcoming the drawbacks of the conventional technologies, the present invention provides a keyboard with height-adjustable keys. When the key is not used, a supporting element is moved to descend a keycap and maintain a lower height of the keycap. Consequently, the thickness of the keyboard is reduced and the space required to store the keyboard is reduced. Moreover, the keyboard is suitably applied to the slim-type electronic device.

In accordance with an aspect of the present invention, there is provided a keyboard with height-adjustable keys. The keyboard includes a switching circuit layer, a key supporting plate, a movable plate and the keys. The key supporting plate is disposed under the switching circuit layer. The movable plate is disposed under the key supporting plate, and movable relative to the key supporting plate. The keys are connected with the key supporting plate, and disposed over the switching circuit layer. Each key includes a keycap, an elastic element and a supporting element. The elastic element is disposed under the keycap and disposed on the switching circuit layer. The supporting element is disposed under the keycap, arranged around the elastic element and connected with the key supporting plate and the keycap. The supporting element includes a first connecting part, a second connecting part and plural bulges. The first connecting part is connected with the key supporting plate, so that the supporting element is fixed on the key supporting plate. The second connecting part is movably connected with the key supporting plate. The plural bulges are protruded downwardly from a bottom surface of the second connecting part, penetrated through the switching circuit layer and the key supporting plate, and inserted in the movable plate. When the second connecting part of the supporting element is in a first position, the keycap is supported by the elastic element, so that the keycap is at a first height. While the movable plate is moved to push the plural bulges, the second connecting part of the supporting element is moved to a second position, and the keycap is correspondingly pulled by the supporting element and moved toward the key supporting plate, so that the keycap is at a second height.

In an embodiment, the keycap is maintained at the first height when the second connecting part of the supporting element is in the first position, and the keycap is maintained at the second height when the second connecting part of the supporting element is in the second position.

In an embodiment, the switching circuit layer includes plural first openings, the key supporting plate includes plural second openings, and the plural bulges are penetrated through the corresponding first openings and the corresponding second openings and inserted in the movable plate.

In an embodiment, each bulge is aligned with the corresponding first opening and the corresponding second opening.

In an embodiment, the movable plate comprises plural locking holes corresponding to respective bulges, and the plural bulges are penetrated through the switching circuit layer and the key supporting plate and inserted in the corresponding locking holes.

In an embodiment, when the second connecting part of the supporting element is in the first position, the bulges are movable in the corresponding locking holes and the keycap is at the first height.

In an embodiment, when the second connecting part of the supporting element is in the first position and the key is depressed, the bulges are moved in the corresponding locking holes, and the keycap is moved with the supporting element and moved toward the key supporting plate.

In an embodiment, while the movable plate is moved, the bulges are pushed to the second position by inner walls of the corresponding locking holes of the movable plate, and the second connecting part of the supporting element is moved to the second position, so that the keycap is correspondingly pulled to a position corresponding to the second height.

In an embodiment, the second height is lower than the first height.

In accordance with another aspect of the present invention, there is provided a keyboard with height-adjustable keys. The keyboard includes a switching circuit layer, a key supporting plate, a movable frame and the keys. The key supporting plate is disposed under the switching circuit layer. The movable frame is disposed over switching circuit layer, and movable relative to the key supporting plate. The movable frame includes plural hollow portions and plural locking structures. The plural locking structures are disposed under the corresponding hollow portion and protruded from a bottom surface of the movable frame and penetrated through the switching circuit layer and the key supporting plate. The keys are connected with the key supporting plate, and disposed over the switching circuit layer. Each key is aligned with the corresponding hollow portion and disposed in the corresponding hollow portion. Each key includes a keycap, an elastic element and a supporting element. The elastic element is disposed under the keycap and disposed on the switching circuit layer. The supporting element is disposed under the keycap, arranged around the elastic element and connected with the key supporting plate and the keycap. The supporting element includes a first connecting part, a second connecting part and plural bulges. The first connecting part is connected with the key supporting plate, so that the supporting element is fixed on the key supporting plate. The second connecting part is movably connected with the key supporting plate. The plural bulges are protruded downwardly from a bottom surface of the second connecting part, and penetrated through the switching circuit layer and the key supporting plate, wherein each bulge corresponds to one of the plural locking structures. When the second connecting part of the supporting element is in a first position, the keycap is supported by the elastic element, so that the keycap is at a first height. While the movable frame is moved to push the plural bulges, the second connecting part of the supporting element is moved to a second position, and the keycap is correspondingly pulled by the supporting element and moved toward the key supporting plate, so that the keycap is at a second height.

In an embodiment, the keycap is maintained at the first height when the second connecting part of the supporting element is in the first position, and the keycap is maintained at the second height when the second connecting part of the supporting element is in the second position.

In an embodiment, the switching circuit layer includes plural first openings, and the key supporting plate includes plural second openings. The plural bulges are penetrated through the corresponding first openings and the corresponding second openings and extended to positions under the key supporting plate. The plural locking structures of the movable frame and the plural bulges of the supporting elements are penetrated through the corresponding first openings and the corresponding second openings and extended to positions under the key supporting plate.

In an embodiment, each locking structure and each bulge are aligned with the corresponding first opening and the corresponding second opening.

In an embodiment, when the second connecting part of the supporting element is in the first position, the bulges are movable and the keycap is at the first height.

In an embodiment, when the second connecting part of the supporting element is in the first position and the key is depressed, the bulges are moved, and the keycap is moved with the supporting element and moved toward the key supporting plate.

In an embodiment, the locking structures of the movable frame are disposed under the second connecting part of the supporting element, and each locking structure and the corresponding bulge are arranged beside each other.

In an embodiment, while the movable plate is moved, the bulges are pushed to the second position by the corresponding locking structures of the movable plate, and the second connecting part of the supporting element is moved to the second position, so that the keycap is correspondingly pulled to a position corresponding to the second height.

In an embodiment, the second height is lower than the first height.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments and accompanying drawings.

Figure 1:
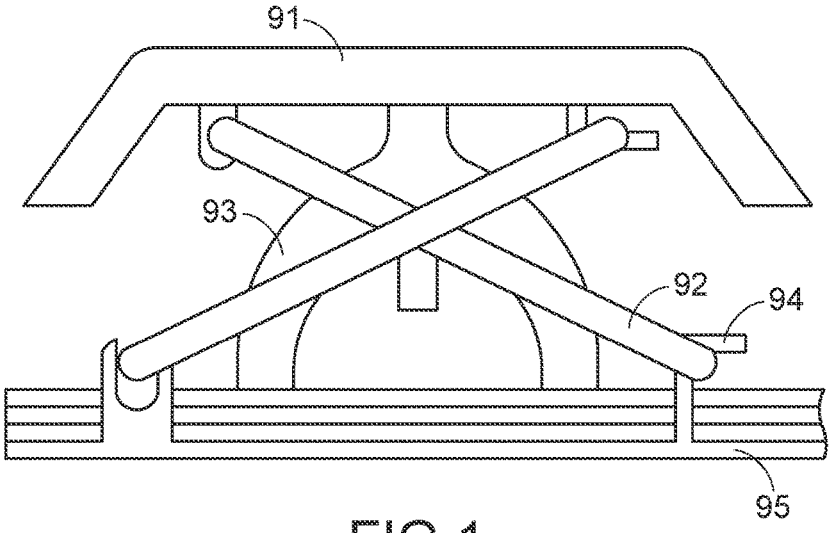
FIG.1 PRIOR ART
FIG. 1 is a schematic side view illustrating the structure of a key of a conventional keyboard.
Figure 2:
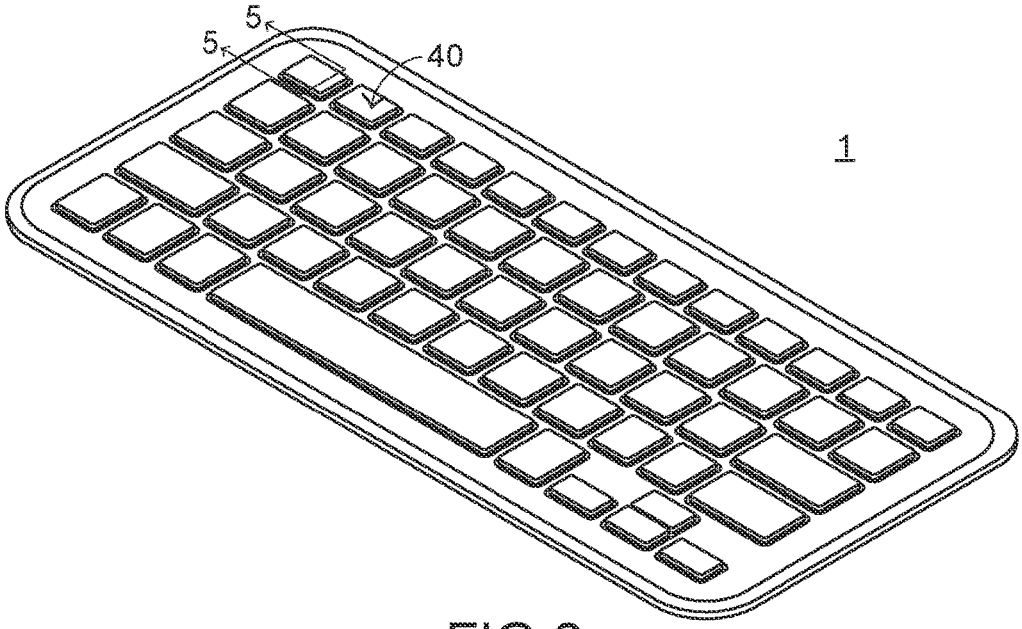
FIG. 2 is a schematic perspective view illustrating a keyboard with height-adjustable keys according to a first embodiment of the present invention.
Figure 3:
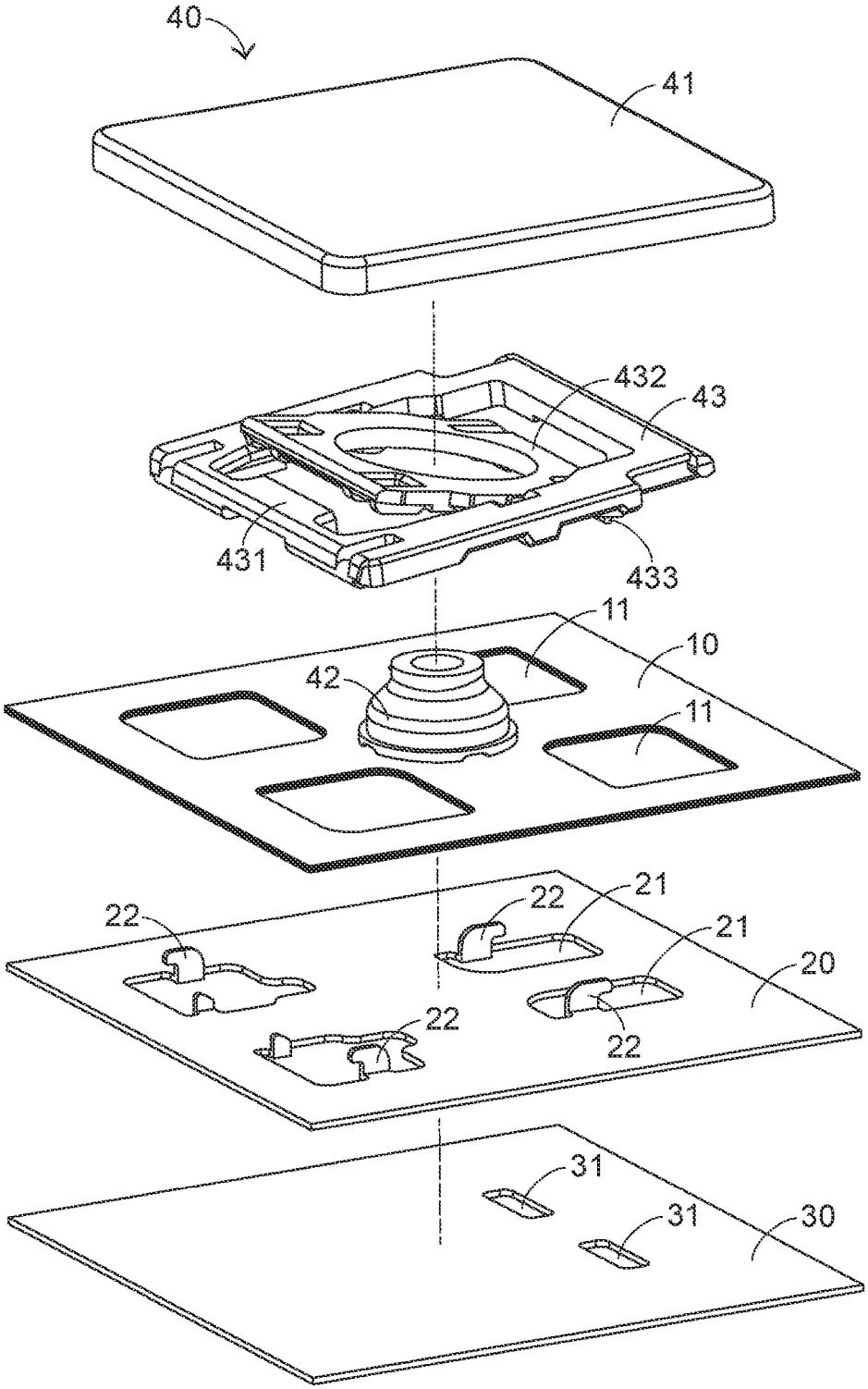
FIG. 3 is a schematic exploded view illustrating a key of the keyboard according to the first embodiment of the present invention.

FIG. 2 is a schematic perspective view illustrating a keyboard with height-adjustable keys according to a first embodiment of the present invention. FIG. 3 is a schematic exploded view illustrating a key of the keyboard according to the first embodiment of the present invention. As shown in FIGS. 2 and 3, the keyboard 1 comprises a switching circuit layer 10, a key supporting plate 20, a movable plate 30 and plural keys 40. The switching circuit layer 10 is used for generating switching signals. The key supporting plate 20 is disposed under the switching circuit layer 10. The movable plate 30 is disposed under the key supporting plate 20, and movable relative to the key supporting plate 20. The plural keys 40 are disposed over the switching circuit layer 10, and connected with the key supporting plate 20.

Each key 40 comprises a keycap 41, an elastic element 42 and a supporting element 43. The supporting element 43 comprises a first connecting part 431, a second connecting part 432 and plural bulges 433. The keycap 41 of the key 40 is disposed over the switching circuit layer 10. The elastic element 42 is disposed under the keycap 41, and disposed on the switching circuit layer 10. The supporting element 43 is disposed under the keycap 41, and arranged around the elastic element 42. The supporting element 43 is connected with the key supporting plate 20 and the keycap 41. Particularly, the first connecting part 431 of the supporting element 43 is connected with the key supporting plate 20, and thus the supporting element 43 is fixed on the key supporting plate 20. Moreover, the second connecting part 432 is movably connected with the key supporting plate 20. The plural bulges 433 are disposed on the second connecting part 432. The plural bulges 433 are protruded downwardly from a bottom surface of the second connecting part 432, penetrated through the switching circuit layer 10 and the key supporting plate 20, and inserted in the movable plate 30.

Figure 8:
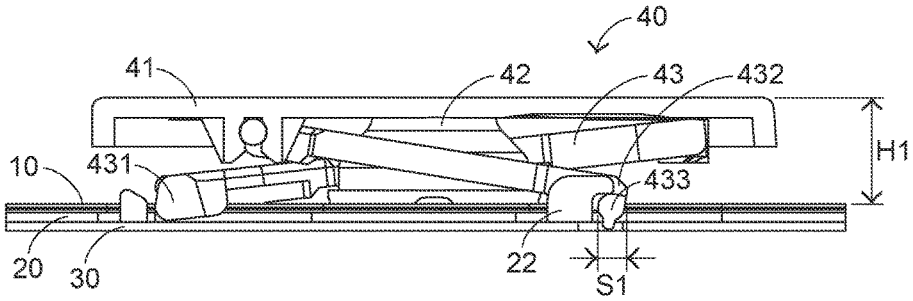
FIG. 8 is a schematic cross-sectional view illustrating a key of the keyboard of FIG. 7 and taken along the line 8-8, in which the key is not depressed.

When the second connecting part 432 of the supporting element 43 is in a first position S1 (see FIG. 8), the keycap 41 is supported by the elastic element 42, and thus the keycap 41 is at a first height H1 (see FIG. 8). As the movable plate 30 is moved to push the bulges 433, the second connecting part 432 of the supporting element 43 is moved to a second position S2 (see FIG. 10). Since the keycap 41 is correspondingly pulled by the supporting element 43 and moved toward the key supporting plate 20, the keycap 41 is moved to a position corresponding to a second height H2 (see FIG. 10). Meanwhile, the keycaps 41 of all keys 40 are all moved to the positions corresponding to the second height H2, and these keycaps 41 are maintained at the second height H2.

Figure 4:
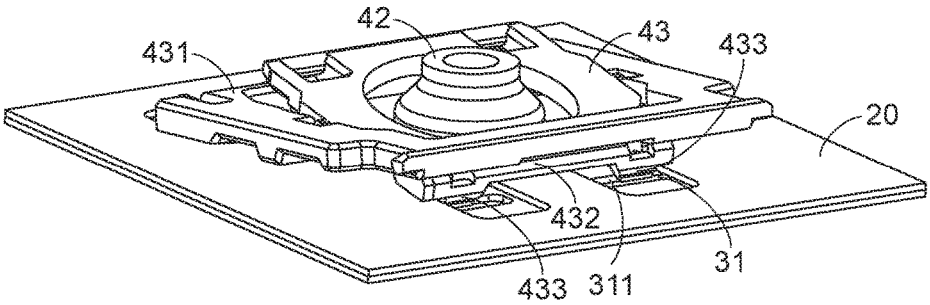
FIG. 4 is a schematic perspective view illustrating the combination of the supporting element, the key supporting plate and the movable plate.

The structures for connecting the supporting element 43 with the key supporting plate 20 and the movable plate 30 will be illustrated in more details as follows. FIG. 4 is a schematic perspective view illustrating the combination of the supporting element, the key supporting plate and the movable plate. Please refer to FIGS. 3 and 4. The switching circuit layer 10 comprises plural first openings 11. The key supporting plate 20 comprises plural second openings 21 and plural fixing hooks 22. The movable plate 30 comprises plural locking holes 31. Each bulge 433 is aligned with the corresponding first opening 11, the corresponding second opening 21 and the corresponding locking hole 31. The first connecting part 431 and the second connecting part 432 of the supporting element 43 are engaged with the corresponding fixing hooks 22 of the key supporting plate 20. Consequently, the supporting element 43 is connected with the key supporting plate 20. Moreover, the bulges 433 on the second connecting part 432 are penetrated through the corresponding first openings 11 of the switching circuit layer 10 and the corresponding second openings 21 of the key supporting plate 20, and inserted in the corresponding locking holes 31 of the movable plate 30. While the movable plate 30 is moved, the bulges 433 are pushed by inner walls 311 of the corresponding locking holes 31. Consequently, the bulges 433 are correspondingly moved with the movable plate 30.

Figure 5:
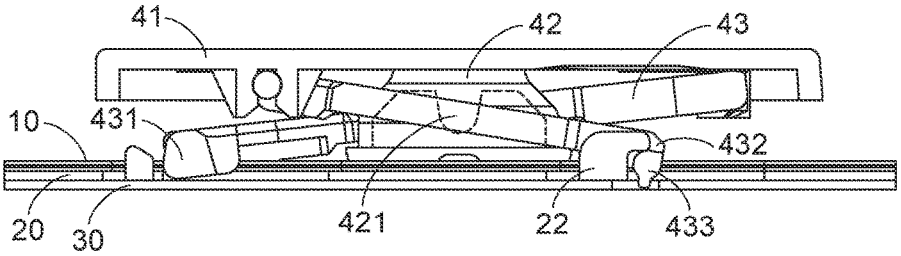
FIG. 5 is a schematic cross-sectional view illustrating the key of the keyboard of FIG. 2 and taken along the line 5-5, in which the key is not depressed.
Figure 6:
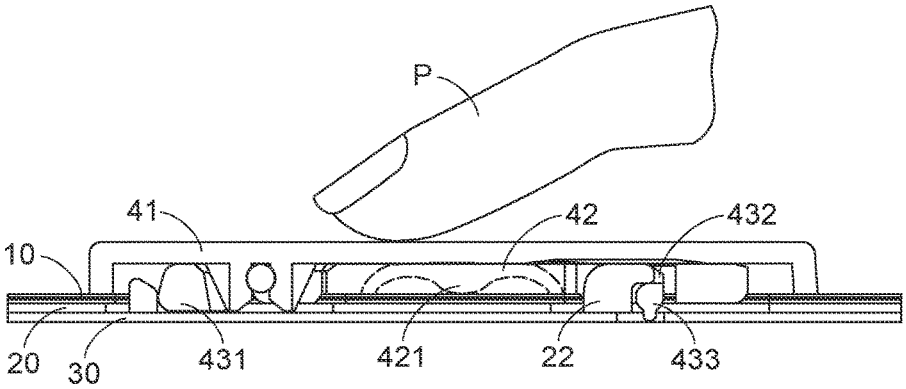
FIG. 6 is a schematic cross-sectional view illustrating the key of FIG. 5, in which the key is depressed.

The way of generating the switching signal by operating the key 40 will be illustrated as follows. FIG. 5 is a schematic cross-sectional view illustrating the key of the keyboard of FIG. 2 and taken along the line 5-5, in which the key is not depressed. FIG. 6 is a schematic cross-sectional view illustrating the key of FIG. 5, in which the key is depressed. As shown in FIG. 5, the key 40 is not depressed. The key 41 is connected with the key supporting plate 20 through the supporting element 43. The key 41 contacted with the keycap 41, and a specified distance between the keycap 41 and the switching circuit layer 10 is maintained. Moreover, a triggering part 421 of the elastic element 42 is not contacted with the switching circuit layer 10. Consequently, no switching signal is generated.

Please refer to FIG. 6. While the keycap 41 is depressed by a user's finger P, the bulges 433 on the second connecting part 432 of the supporting element 43 are moved in the corresponding locking holes (see FIG. 4) of the movable plate 30 and the second connecting part 432 is correspondingly moved. Consequently, the supporting element 43 is descended toward the switching circuit layer 10, and the keycap 41 is correspondingly moved toward the switching circuit layer 10 and the key supporting plate 20. As the keycap 41 is moved downwardly, the elastic element 42 is pushed by the keycap 41, and the triggering part 421 of the elastic element 42 is contacted with the switching circuit layer 10. Consequently, the switching circuit layer 10 generates a switching signal. Then, the switching signal is converted into a command or an input message by a controller (not shown) of the keyboard. The command or the input message is transmitted to a computer. When the keycap 41 is no longer depressed by the user's finger P, the keycap 41 is returned to its original position in response to the elastic force of the elastic element 42.

Figure 7:
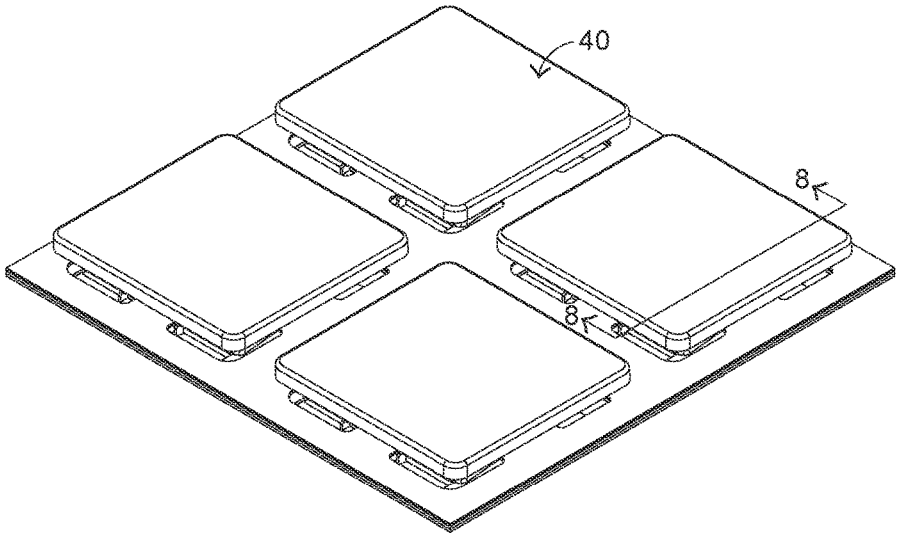
FIG. 7 is a schematic perspective view illustrating some keys of the keyboard according to the first embodiment of the present invention, in which the keys are not depressed.

The way of moving the movable plate 30 to descend the keycap 41 of the key 40 and maintain the lower height of the keycap 41 through will be illustrated as follows. FIG. 7 is a schematic perspective view illustrating some keys of the keyboard according to the first embodiment of the present invention, in which the keys are not depressed. FIG. 8 is a schematic cross-sectional view illustrating a key of the keyboard of FIG. 7 and taken along the line 8-8, in which the key is not depressed. As shown in FIGS. 7 and 8, all of the keys 40 are not depressed. Meanwhile, the keycap 41 of each key 40 is at the first height H1, and the second connecting part 432 and the bulges 433 of the supporting element 43 are in the first position S1. Under this circumstance, the bulges 433 are movable in the corresponding locking holes 31 of the movable plate 30, and the key 40 can be depressed to generate the switching signal and the key 40 can be returned to its original position.

Figure 9:
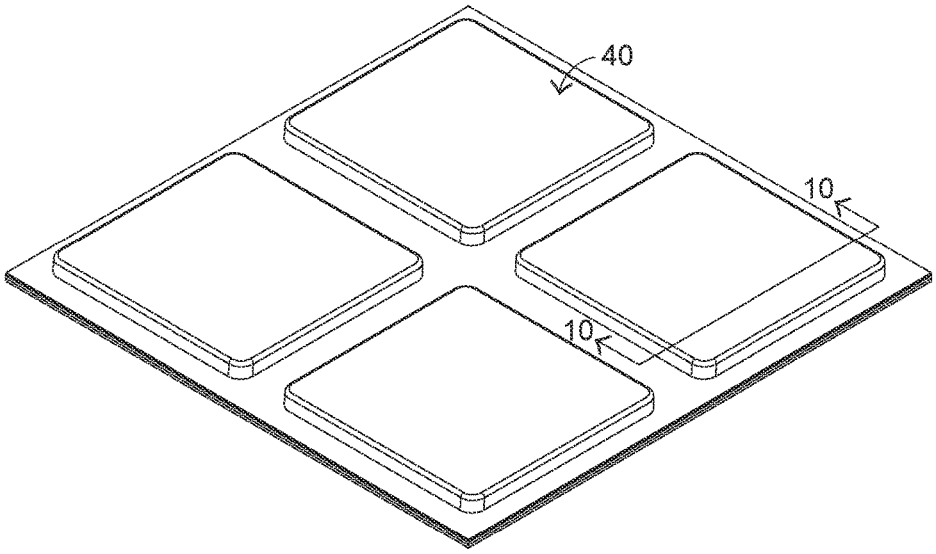
FIG. 9 is a schematic perspective view illustrating some keys of the keyboard according to the first embodiment of the present invention, in which the heights of keys are lowered.
Figure 10:
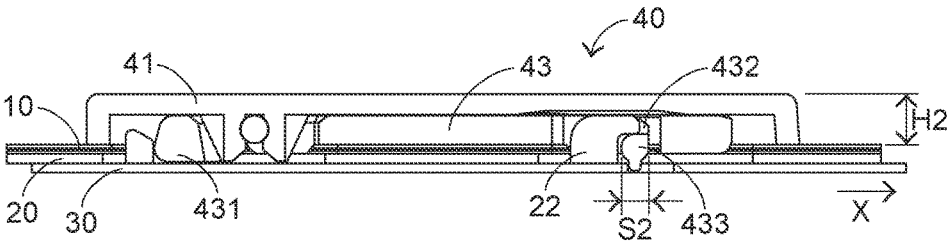
FIG. 10 is a schematic cross-sectional view illustrating a key of the keyboard of FIG. 9 and taken along the line 10-10, in which the height of the key is lowered.

FIG. 9 is a schematic perspective view illustrating some keys of the keyboard according to the first embodiment of the present invention, in which the heights of keys are lowered. FIG. 10 is a schematic cross-sectional view illustrating a key of the keyboard of FIG. 9 and taken along the line 10-10, in which the height of the key is lowered. For lowering the height of the key 40, the movable plate 30 is moved in a specified direction X. When the movable plate 30 is moved to a stopped position and fixed in the stopped position, the movable plate 30 is not returned back. While the movable plate 30 is moved, the bulges 433 are pushed by the inner walls 311 of the corresponding locking holes 31 of the movable plate 30 and moved to the second position S2. As the second connecting part 432 is moved to the second position S2, the supporting element 43 is descended toward the switching circuit layer 10 and the key supporting plate 20, and the keycap 41 is moved to the position corresponding to the second height H2. Moreover, since the elastic element 42 is pushed by the keycap 41, the height of the elastic element 42 is correspondingly lowered. In this embodiment, the second height H2 is lower than the first height H1. Moreover, since the movable plate 30 is fixed in the stopped position, the bulges 433 are continuously pushed by the inner walls 311 (see FIG. 4) of the corresponding locking holes 31 and fail to be moved in the locking holes 31. The supporting element 43 and the keycap 41 are maintained at the descended status. Under this circumstance, the keycap 41 cannot be returned to its original position in response to the elastic force of the elastic element 42. Since the key 40 is maintained at the lower height and the key 40 fails to be depressed, no switching signal is generated. Meanwhile, the bulges 433 and the second connecting parts 432 of the supporting elements 43 of all keys 40 are moved to the second position S2, and the keycaps 41 are at the second height H2. That is, the heights of all keys 40 are lowered.

The way of moving the movable plate 30 is not restricted. In an embodiment, the movable plate 30 is moved manually. In another embodiment, the movable plate 30 is moved through a mechanism of the keyboard and the peripheral device. Moreover, the way of fixing the movable plate 30 in the stopped position is not restricted. For example, an additional component is installed within the keyboard for fixing the movable plate 30, or a mechanism of the keyboard peripheral device is used for fixing the movable keyboard 30. After the movable plate 30 is returned to its original position, all keys 40 are restored to their original heights. Meanwhile, the bulges 433 are no longer pushed by the inner walls 311 of the corresponding locking holes 31. In response to the elastic force of the elastic element 42, the keycap 41 is returned to its original height H1.

Figure 11:
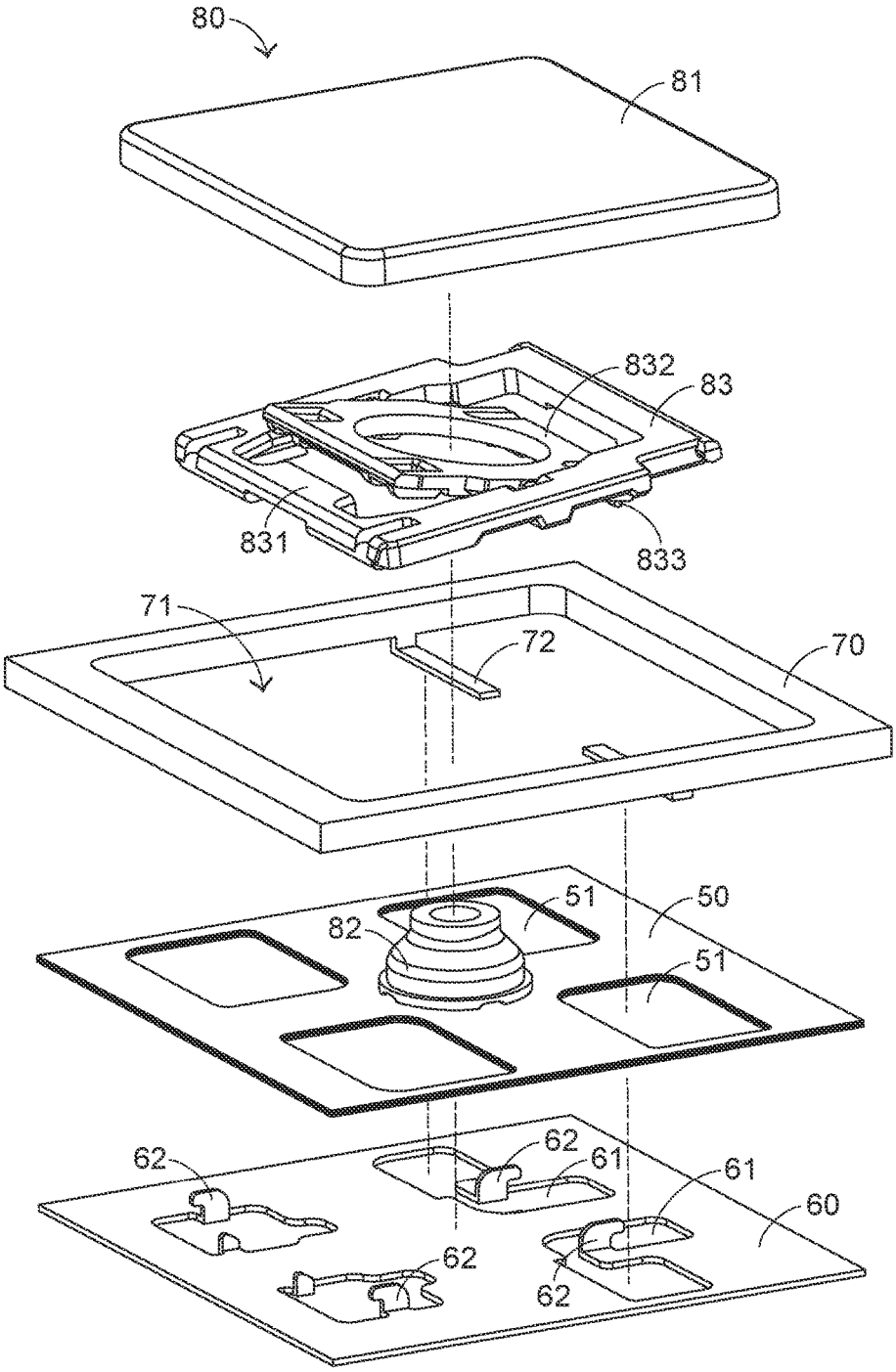
FIG. 11 is a schematic exploded view illustrating a key of a keyboard according to a second embodiment of the present invention.

The present invention further provides a keyboard with height-adjustable keys according to a second embodiment. FIG. 11 is a schematic exploded view illustrating a key of a keyboard according to a second embodiment of the present invention. The key arrangements of the keyboard of this embodiment and the way of depressing the key to generating the switching signal are similar to those of the first embodiment, and are not redundantly described herein. As shown in FIG. 11, the keyboard of this embodiment comprises a switching circuit layer 50, a key supporting plate 60, a movable frame 70 and plural keys 80. The key supporting plate 60 is disposed under the switching circuit layer 50. The plural keys 80 are disposed over the switching circuit layer 50, and connected with the key supporting plate 60. The movable frame 70 is disposed over the switching circuit layer 50, and arranged around the key 80. The movable frame 70 is movable relative to the key supporting plate 60. The switching circuit layer 50 comprises plural first openings 51. The key supporting plate 60 comprises plural second openings 61 and plural fixing hooks 62. The movable frame 70 comprises plural hollow portions 71 and plural locking structures 72.

Each key 80 comprises a keycap 81, an elastic element 82 and a supporting element 83. The supporting element 83 comprises a first connecting part 831, a second connecting part 832 and plural bulges 833. Each key 80 is aligned with the corresponding hollow portion 71. The key 80 is disposed in the corresponding hollow portion 71 of the movable frame 70. That is, the movable frame 70 is arranged around the key 80. The first connecting part 831 and the second connecting part 832 of the supporting element 83 are engaged with the corresponding fixing hooks 62 of the key supporting plate 60. Consequently, the supporting element 83 is connected with the key supporting plate 60. The keycap 81 is connected with the key supporting plate 60 through the supporting element 83. The elastic element 82 is contacted with the keycap 81. Each bulge 833 of the supporting element 83 is aligned with the corresponding first opening 51 and the corresponding second opening 61. Moreover, the bulge 833 is penetrated through the corresponding first opening 51 of the switching circuit layer 50 and the corresponding second opening 61 of the key supporting plate 60 and extended to a position under the key supporting plate 60. The plural locking structures 72 of the movable frame 70 are disposed under the corresponding hollow portion 71. Each locking structure 72 is aligned with the corresponding first opening 51 and the corresponding second opening 61. The locking structures 72 are protruded from a bottom surface of the movable frame 70, and penetrated downwardly through the corresponding first openings 51 of the switching circuit layer 50 and the corresponding second openings 61 of the key supporting plate 60. Moreover, the locking structures 72 are extended to the positions under the supporting element 83 and corresponding to the bulges 833. Moreover, the locking structure 72 and the corresponding bulge 833 are arranged beside each other. While the movable frame 70 is moved, the bulges 833 are pushed by the corresponding locking structures 72, and the bulges 833 are correspondingly moved.

Figure 12:
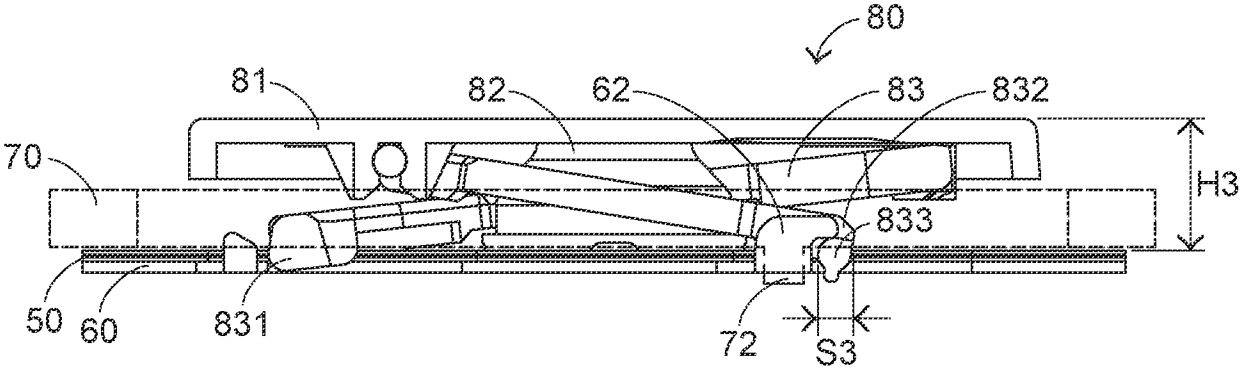
FIG. 12 is a schematic cross-sectional view illustrating the key of the keyboard according to the second embodiment of the present invention, in which the key is not depressed.

FIG. 12 is a schematic cross-sectional view illustrating the key of the keyboard according to the second embodiment of the present invention, in which the key is not depressed. As shown in FIG. 12, the key 80 is not depressed. The connecting part 832 and the bulges 833 of the supporting element 83 are in a first position S3. The keycap 81 is supported by the elastic element 82 and the supporting element 83, and thus the keycap 81 is at a first height H3. Moreover, the bulges 833 are not pushed by the corresponding locking structures 72 of the movable frame 70. Under this circumstance, the bulges 833 are movable, and the keycap 81 can be depressed. The keycap 81 is correspondingly pulled by the supporting element 83 and moved toward the switching circuit layer 50 and the key supporting plate 60. Consequently, a switching signal (not shown) is generated.

Figure 13:
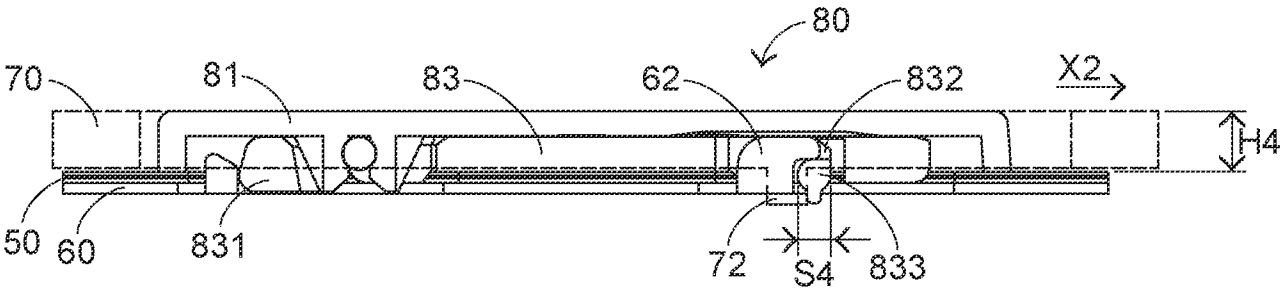
FIG. 13 is a schematic cross-sectional view illustrating a key of the keyboard according to the second embodiment of the present invention, in which the height of key is lowered.

FIG. 13 is a schematic cross-sectional view illustrating a key of the keyboard according to the second embodiment of the present invention, in which the height of key is lowered. For lowering the height of the key 80, the movable frame 80 is moved in a specified direction X2. When the movable frame 80 is moved to a stopped position and fixed in the stopped position, the movable frame 80 is not returned back. While the movable frame 80 is moved, the bulges 833 are contacted and pushed by the corresponding locking structures 72 of the movable frame 70 and moved to a second position S4. As the second connecting part 832 of the supporting element 83 is moved to the second position S4, the supporting element 83 is descended toward the key supporting plate 60, and the keycap 81 is moved to the position corresponding to a second height H2. Moreover, since the elastic element 82 is pushed by the keycap 81, the height of the elastic element 82 is correspondingly lowered. In this embodiment, the second height H2 is lower than the first height H1. That is, the height of the key 80 is lower. Moreover, since the movable frame 70 is fixed in the stopped position, the bulges 833 are continuously contacted by the corresponding locking structures 72 and fail to be moved. The supporting element 83 and the keycap 81 are maintained at the descended status. Under this circumstance, the keycap 81 cannot be returned to its original position in response to the elastic force of the elastic element 82. Since the keycap 81 is maintained at the second height H2 and the keycap 81 fails to be depressed, no switching signal is generated.

The way of moving the movable frame 70 is not restricted. In an embodiment, the movable frame 70 is moved manually. In another embodiment, the movable frame 70 is moved through a mechanism of the keyboard and the peripheral device. Moreover, the way of fixing the movable frame 70 in the stopped position is not restricted.

For example, an additional component is installed within the keyboard for fixing the movable frame 70, or a mechanism of the keyboard peripheral device is used for fixing the movable frame 70. After the movable frame 70 is returned to its original position, all keys 80 are restored to their original heights. Meanwhile, the bulges 833 are no longer pushed by the corresponding locking structures 72 of the movable frame 70. In response to the elastic force of the elastic element 82, the keycap 81 is returned to its original height H3.

From the above descriptions, the present invention provides the keyboard with height-adjustable keys. By moving the movable plate, the supporting element is correspondingly moved. As the supporting element is moved, the keycap is moved downwardly and the keycap is maintained at a lower height. Since the thickness of the keyboard is reduced, the drawbacks of the conventional technologies are overcome.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard with height-adjustable keys, the keyboard comprising:

a switching circuit layer;

a key supporting plate disposed under the switching circuit layer;

a movable plate disposed under the key supporting plate, and movable relative to the key supporting plate; and the keys connected with the key supporting plate, and disposed over the switching circuit layer, wherein each key comprises a keycap, an elastic element and a supporting element, wherein the elastic element is disposed under the keycap and disposed on the switching circuit layer, and the supporting element is disposed under the keycap, arranged around the elastic element and connected with the key supporting plate and the keycap, wherein the supporting element comprises:

a first connecting part connected with the key supporting plate, so that the supporting element is fixed on the key supporting plate;

a second connecting part movably connected with the key supporting plate; and plural bulges protruded downwardly from a bottom surface of the second connecting part, penetrated through the switching circuit layer and the key supporting plate, and inserted in the movable plate, wherein when the second connecting part of the supporting element is in a first position, the keycap is supported by the elastic element, so that the keycap is at a first height, wherein while the movable plate is moved to push the plural bulges, the second connecting part of the supporting element is moved to a second position, and the keycap is correspondingly pulled by the supporting element and moved toward the key supporting plate, so that the keycap is at a second height.

2. The keyboard according to claim 1, wherein when the second connecting part of the supporting element is in the first position, the keycap is maintained at the first height, wherein when the second connecting part of the supporting element is in the second position, the keycap is maintained at the second height.

3. The keyboard according to claim 1, wherein the switching circuit layer comprises plural first openings, the key supporting plate comprises plural second openings, and the plural bulges are penetrated through the corresponding first openings and the corresponding second openings and inserted in the movable plate.

4. The keyboard according to claim 3, wherein each bulge is aligned with the corresponding first opening and the corresponding second opening.

5. The keyboard according to claim 1, wherein the movable plate comprises plural locking holes corresponding to respective bulges, and the plural bulges are penetrated through the switching circuit layer and the key supporting plate and inserted in the corresponding locking holes.

6. The keyboard according to claim 5, wherein when the second connecting part of the supporting element is in the first position, the bulges are movable in the corresponding locking holes and the keycap is at the first height.

7. The keyboard according to claim 6, wherein when the second connecting part of the supporting element is in the first position and the key is depressed, the bulges are moved in the corresponding locking holes, and the keycap is moved with the supporting element and moved toward the key supporting plate.

8. The keyboard according to claim 5, wherein while the movable plate is moved, the bulges are pushed to the second position by inner walls of the corresponding locking holes of the movable plate, and the second connecting part of the supporting element is moved to the second position, so that the keycap is correspondingly pulled to a position corresponding to the second height.

9. The keyboard according to claim 1, wherein the second height is lower than the first height.

10. A keyboard with height-adjustable keys, the keyboard comprising:

a switching circuit layer;

a key supporting plate disposed under the switching circuit layer;

a movable frame disposed over switching circuit layer, and movable relative to the key supporting plate, wherein the movable frame comprises plural hollow portions and plural locking structures, and the plural locking structures are disposed under the corresponding hollow portion and protruded from a bottom surface of the movable frame and penetrated through the switching circuit layer and the key supporting plate; and the keys connected with the key supporting plate, and disposed over the switching circuit layer, wherein each key is aligned with the corresponding hollow portion and disposed in the corresponding hollow portion, and each key comprises a keycap, an elastic element and a supporting element, wherein the elastic element is disposed under the keycap and disposed on the switching circuit layer, and the supporting element is disposed under the keycap, arranged around the elastic element and connected with the key supporting plate and the keycap, wherein the supporting element comprises:

a first connecting part connected with the key supporting plate, so that the supporting element is fixed on the key supporting plate;

a second connecting part movably connected with the key supporting plate; and plural bulges corresponding to the plural locking structures, wherein the plural bulges are protruded downwardly from a bottom surface of the second connecting part, and penetrated through the switching circuit layer and the key supporting plate, wherein each bulge corresponds to one of the plural locking structures, wherein when the second connecting part of the supporting element is in a first position, the keycap is supported by the elastic element, so that the keycap is at a first height, wherein while the movable frame is moved to push the plural bulges, the second connecting part of the supporting element is moved to a second position, and the keycap is correspondingly pulled by the supporting element and moved toward the key supporting plate, so that the keycap is at a second height.

11. The keyboard according to claim 10, wherein when the second connecting part of the supporting element is in the first position, the keycap is maintained at the first height, wherein when the second connecting part of the supporting element is in the second position, the keycap is maintained at the second height.

12. The keyboard according to claim 10, wherein the switching circuit layer comprises plural first openings, and the key supporting plate comprises plural second openings, wherein the plural locking structures of the movable frame and the plural bulges of the supporting elements are penetrated through the corresponding first openings and the corresponding second openings and extended to positions under the key supporting plate.

13. The keyboard according to claim 12, wherein each locking structure and each bulge are aligned with the corresponding first opening and the corresponding second opening.

14. The keyboard according to claim 10, wherein when the second connecting part of the supporting element is in the first position, the bulges are movable and the keycap is at the first height.

15. The keyboard according to claim 14, wherein when the second connecting part of the supporting element is in the first position and the key is depressed, the bulges are moved, and the keycap is moved with the supporting element and moved toward the key supporting plate.

16. The keyboard according to claim 10, wherein the locking structures of the movable frame are disposed under the second connecting part of the supporting element, and each locking structure and the corresponding bulge are arranged beside each other.

17. The keyboard according to claim 10, wherein while the movable plate is moved, the bulges are pushed to the second position by the corresponding locking structures of the movable plate, and the second connecting part of the supporting element is moved to the second position, so that the keycap is correspondingly pulled to a position corresponding to the second height.

18. The keyboard according to claim 10, wherein the second height is lower than the first height.

* * * * *